US006402152B1

(12) United States Patent
Kutzik

(10) Patent No.: US 6,402,152 B1
(45) Date of Patent: Jun. 11, 2002

(54) COLLECTIBLE ELEMENTS AND GAME METHOD USING INDICIA OF OCCURRENCE

(76) Inventor: Robert Kutzik, 311 Carleton La., Mount Laurel, NJ (US) 08054

( * ) Notice: Subject to any disclaimer, the term of this patent is extended or adjusted under 35 U.S.C. 154(b) by 0 days.

(21) Appl. No.: 09/400,629

(22) Filed: Sep. 20, 1999

(51) Int. Cl.[7] ..... A63F 1/00

(52) U.S. Cl. ..... 273/296; 273/292; 273/293; 273/244; 273/245; 273/246; 273/302; 273/304; 273/308; 463/11; 463/13; 463/23

(58) Field of Search ..... 273/292, 293, 273/296, 302, 304, 308, 244, 245, 246; 463/11, 13, 23

(56) References Cited

U.S. PATENT DOCUMENTS

| | | | | | |
|---|---|---|---|---|---|
| 133,296 | A | * | 11/1872 | Bradley | 273/308 |
| 142,423 | A | * | 9/1873 | West et al. | 273/302 |
| 157,381 | A | * | 12/1874 | Dew | 273/302 |
| 637,699 | A | * | 11/1899 | Bickford | 273/308 |
| 678,791 | A | * | 7/1901 | Ford | 273/308 |
| 928,511 | A | * | 7/1909 | Eddins | 273/308 |
| 960,205 | A | * | 5/1910 | Shakespeare, Jr. | 273/308 |
| 1,263,664 | A | * | 4/1918 | Hanada | 273/302 |
| 1,273,024 | A | * | 7/1918 | Branch | 273/308 |
| 1,327,019 | A | * | 1/1920 | Britton | 273/308 |
| 1,357,166 | A | * | 10/1920 | Hart | 273/302 |
| 1,381,643 | A | * | 6/1921 | Jourdan | 273/308 |
| 1,390,659 | A | * | 9/1921 | Vaughn | 273/308 |
| 1,658,751 | A | * | 2/1928 | Wiekert | 273/308 |
| 2,681,804 | A | * | 6/1954 | Stover | 273/135 |
| 3,096,092 | A | * | 7/1963 | Breedhorn | 273/135 |
| 3,606,336 | A | * | 9/1971 | Krause | 273/135 D |
| 5,193,818 | A | * | 3/1993 | Leeson | 273/430 |
| 5,549,301 | A | * | 8/1996 | Gerrard | 273/305 |
| 5,645,280 | A | * | 7/1997 | Zelmer | 273/256 |
| 5,690,336 | A | * | 11/1997 | Oliver | 273/302 |
| 5,833,536 | A | * | 11/1998 | Davids et al. | 463/9 |
| 5,836,587 | A | * | 11/1998 | Druce et al. | 273/296 |
| 5,934,675 | A | * | 8/1999 | Handelman et al. | 273/292 |
| 5,957,774 | A | * | 9/1999 | Holmes et al. | 463/13 |

OTHER PUBLICATIONS

Pokeman Made Simple, pp. 31–37.
Who Am I; By A&E, Game Directions.

* cited by examiner

*Primary Examiner*—Jeannette Chapman
*Assistant Examiner*—D Collins
(74) *Attorney, Agent, or Firm*—Caesar, Rivise, Bernstein, Cohen & Pokotilow, Ltd.

(57) ABSTRACT

A collectible element suitable for use in an educational game having a plurality of collectible elements each having a frequency of occurrence related to the number of occurrences of the collectible element with respect to the number of occurrences of other collectible elements of the plurality of collectible elements is disclosed. The collectible element includes an indicia of the frequency of occurrence of the collectible element disposed upon the collectible element. The collectible elements can be cards and a player of a card game can obtain credit in accordance with the frequency of occurrence including in accordance with skill. Furthermore, the collectible element can set forth a character and a player of the game can obtain credit in accordance with skill in identifying the character. The frequency of occurrence of a collectible element is related to the amount of skill required to identify the character set forth on the collectible element. The character set forth on the collectible element is a real person, preferably a dead person. If the character set forth on the collectible element is a relatively famous person the frequency of occurrence of the collectible element is accordingly relatively high. If the character set forth on the collectible element is a relatively obscure person the frequency of occurrence of the collectible element is accordingly relatively low.

39 Claims, 2 Drawing Sheets

COLLECTIBLE ELEMENTS AND GAME METHOD USING INDICIA OF OCCURRENCE

BACKGROUND OF THE INVENTION

I. Field of the Invention

This invention relates to the field of card games and, in particular, to the field of card games having game elements useful for playing card games and also useful as collectibles.

II. Prior Art

Trading cards are a well-known method for disbursing and collecting information about public figures. For example trading cards representing figures in the entertainment industry can depict music performers or television and movie personalities. A more familiar type of trading card is the well-known baseball card. Baseball cards are provided with a photographic depiction of an athlete along with biographic and statistical information concerning various athletes and teams. Other cards dealing with sports figures are also available and are used by sports enthusiasts for collecting information about athletes and sports teams.

Sales in the sports card industry greatly expanded during the 1980's. Despite some decline since that period the sports card industry is still a major market. However, new markets have also developed. For example, while cards depicting wars and presidents have been in existence since the 1930's, in the 1990's new non-sport cards have effectively tapped into the large youth market. These cards usually have as subject matter comic book or fantasy heroes.

Additionally, trading cards directed to niche markets continue to develop. The sports and non-sports subject matter can be as varied and obscure as women's bowling, bass fishing, and National Historical Parks. All these card sets and more are produced each year. But the most successful sets are those with wide appeal that contain opportunities to have ongoing content for the cards. This partly accounts for the success of sports cards. However, any type of cards can be used by enthusiasts of the subject matter as trading cards.

Enthusiasts typically exchange trading cards with other enthusiasts in order to obtain cards that are needed to complete sets of related cards or to obtain cards that are not readily available. Collectors can also buy and sell trading cards for their economic and historic value. Trading cards of this type are typically sold through retail game stores and other types of specialty outlets, particularly neighborhood baseball card shops depending, for example, upon the popularity of the individuals depicted thereon. Additionally, since some trading cards are more common than others, the monetary value of a card can depend on its availability. For instance it is known to provide inserts of special cards in many sports card sets. An example would be "Michael Jordan Golden Hoop Club Card 1:35." This information will often appear on the wrapper of the cards.

There is presently no systematic way to determine the scarcity of a card other than background knowledge. The background knowledge may be provided by information available on a wrapper indicating which cards are special inserts that are more rare than the common cards. Alternately, it may be known through knowledge of the subject matter. However, there is no system for identifying the scarcity of cards immediately upon viewing the cards.

Playing cards, as distinguished from trading cards, are easily and readily available. This is especially true of the well-known decks of fifty-two face cards. Many different games can be played with a single deck of this type of playing cards. The number of games possible is limited for the most part only by the imagination of the players. Playing cards themselves, individually and collectively, usually have no value other than their amusement value. Additionally, some card games require cards especially printed for the game. Cards of this nature have little value other than their value for the playing of the particular game for which they are printed.

Many games played with playing cards such as the more common face cards are games of chance. Games of chance can have rules that require either the random selection of cards or in some other way depend upon the occurrence of events outside the control of the players. Other games played with cards can require strategy. Strategy games usually limit the level of strategy with restrictive rules of play.

A further type of trading card known in the prior art and currently gaining in popularity is a card that is significantly different from the previous trading cards of the twentieth century. It is a trading card that uses the scarcity of a card as a legitimate basis for collectibility and for the value of the card. However, these trading values are not identifiable to the layman. In the case of these collectible card games cards are sometimes categorized as rare, uncommon, and common. However, these trading values are not identifiable to the layman. This type of card es rapidly gaining in popularity mostly through word of mouth.

However, in the last ten years collectible card games such as these have made a significant impact on both the trading card industry and on the game industry. Collectible card suitable for use in playing games of this nature are also known as fantasy trading cards. At the present time fantasy card games represent fictional characters and situations.

One such game is a fantasy game utilizing figures such as sorcerers and wizards as subject matter. Another such game utilizes a science fiction universe previously created for television and movie entertainment. Fantasy games include cards that are more rare than other cards. However, it is not integral when using the cards which ones may be more rare.

It is also known to provide games that use freely tradable game elements or components, such as trading cards. Furthermore, it is known to provide games that enable a player to form a unique combination of components that competes against the combinations of elements formed by other players.

It is an object of the present invention to provide a card game and a card element wherein the value of the card element as a collector item corresponds to the value of the card element within the card game.

It is another object of the present invention to provide a card that is both a collectible suitable for use in a number of game formats including an educational trivia game, a card game, and a fantasy game.

It is a further object of the present invention to provide a card game and a game element wherein the value of a game element as a collectible and the value of the game element in a card game are related to the scarcity of the game element.

It is a further object of the invention to provide a game card element suitable for sale in a starter set of cards as well as in separately sold supplementary or booster sets of cards.

It is a further object of the invention to provide a card wherein a feature identifying the scarcity of the card is a part of a system for identifying the scarcity of the card immediately upon viewing the card without reference to a book, wrapper or prior knowledge of details of game or individual card.

It is a further object of the present invention to associate predetermined fantasy card game elements with real individuals.

SUMMARY OF THE INVENTION

A collectible element suitable for use in an educational game having a plurality of collectible elements each having a frequency of occurrence related to the number of occurrences of the collectible element with respect to the number of occurrences of other collectible elements of the plurality of collectible elements is disclosed. The collectible element includes an indicia of the frequency of occurrence of the collectible element disposed upon the collectible element. The collectible elements can be cards and a player of a card game can obtain credit in accordance with the frequency of occurrence including in accordance with skill. Furthermore, the collectible element can set forth a character and a player of the game can obtain credit in accordance with skill in identifying the character. The frequency of occurrence of a collectible element is related to the amount of skill required to identify the character set forth on the collectible element. The character set forth on the collectible element is a real person, preferably a dead person. If the character set forth on the collectible element is a relatively famous person the frequency of occurrence of the collectible element is accordingly relatively high. If the character set forth on the collectible element is a relatively obscure person the frequency of occurrence of the collectible element is accordingly relatively low. The plurality of collectible elements can be a first set of collectible elements obtained together with each other and a second set of collectible elements obtained together with each other and obtained separately from the first set of collectible elements wherein the first and second sets of collectible elements are joined together while substantially maintaining the accuracy of the frequency of occurrence of the collectible elements of the first and second sets of collectible elements.

BRIEF DESCRIPTION OF THE DRAWINGS

The features, objects, and advantages of the present invention will become more apparent from the detailed description set forth below when taken in conjunction with the drawings in which like reference characters identify corresponding elements throughout and wherein FIGS. 1A, B show the reverse and obverse sides of the playing cards of the present invention.

DETAILED DESCRIPTION OF THE INVENTION

Figure 1A:
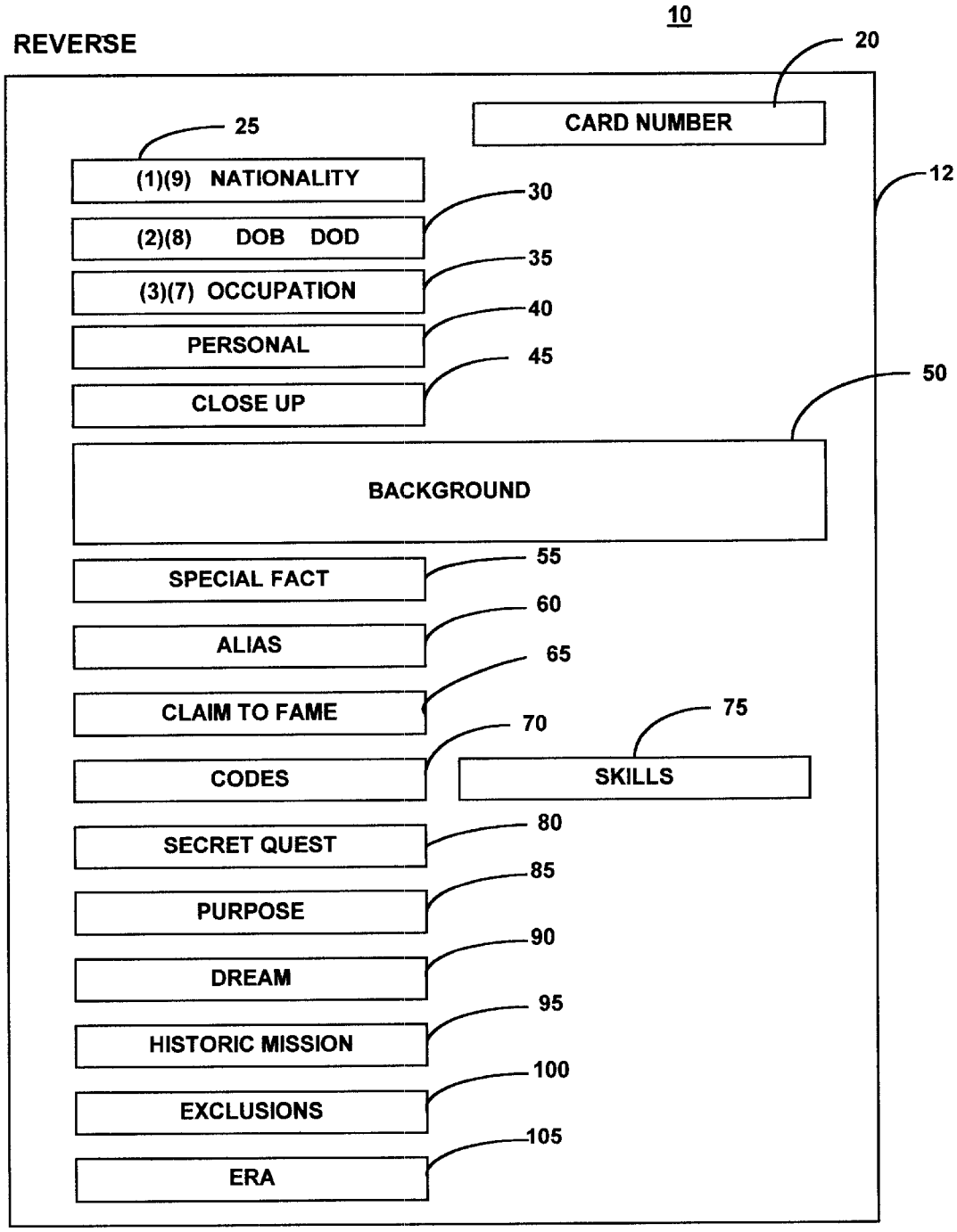
Figure 1B:
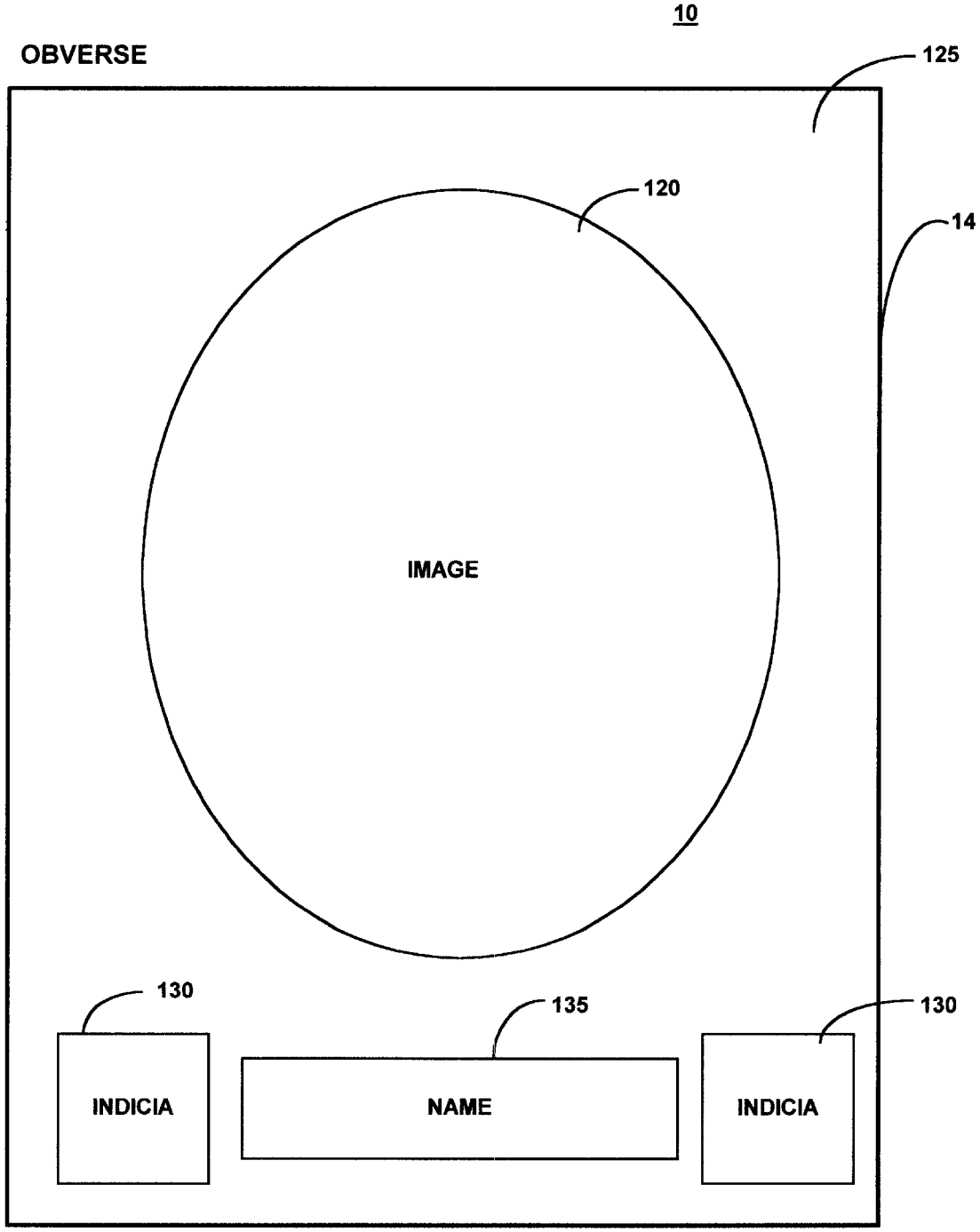

Referring now to FIGS. 1A, B, there are shown reverse side 12 and obverse side 14 of frequency indicia bearing collectible element 10 of the present invention. In one preferred embodiment of the invention frequency indicia bearing collectible element 10 can be a frequency indicia bearing card 10. Frequency indicia bearing card 10 is one of a plurality of such cards that can be used together as a set of cards for game playing while also being suitable for use as collectibles. In their capacity as cards used for game playing frequency indicia bearing cards 10 can be used to play any number of educational games.

For example, cards 10 can be elements of trivia, fantasy, and collectible games. While cards 10 are illustrated and described primarily as cards such as the rigid cards of a conventional hard deck of cards, like the rigid cards they can be represented as images, electrical signals in one preferred embodiment and in any other manner known to those skilled in the art. In these embodiments software operating upon conventional hardware can provide the required images of cards 10, any required motion of the images of the game, as well as the algorithms for implementing the desired games. The educational games using frequency indicia bearing cards 10 are designed to provide users with a great deal of fun while helping users to master skills such as history, memory, and strategy.

In their capacity as collectibles frequency indicia bearing cards 10 can be exchanged between users in order to permit the users to obtain new cards 10. For example, users can exchange cards 10 in order to obtain other cards 10 that are more rare or to obtain cards 10 that are merely of more interest to a user. Even while serving as trading cards in this manner or in any other way serving as a collectible element frequency indicia bearing cards 10 can be educational.

Each frequency indicia bearing card 10 of the present invention is an element that sets forth a character that is the subject matter of the card. In the preferred method of the invention the character set forth is a dead person. Furthermore, in the preferred embodiment of the invention, an individual set forth on frequency indicia bearing card 10 can be any person who ever lived regardless of how famous, obscure, or infamous the individual may be. Each of the characters appearing on frequency indicia bearing cards 10 appears with a predetermined frequency. However, it will be understood that the subject of indicia bearing cards 10 can be provided with any other subject matter such as animals or objects.

Obverse side 14 of frequency indicia bearing card 10 includes image region 120 of the character set forth. Image region 120 is disposed against card background 125. Card background 125 can be any one of a number of differing colors. The differing colors of card background 125 can be used to indicate differing backgrounds of the various characters. For example, in the preferred embodiment of the invention differing colors can be use to indicate characters in the fields of science and business, the military and outlaws, reformers and religious figures, politicians, and royalty along with characters famous through their relationships.

Name field 135 is also provided on obverse side 14 of frequency indicia bearing card 10. Name field 135 is provided in order to set forth the name of the character that is the subject matter of card 10. The name set forth within name field 135 is usually the first and last name of the character. However, a nickname or only a last name of a character can be used within name field 135 occasionally.

One or more indicia fields 130 are also provided on obverse side 14 of frequency indicia bearing card 10. Indicia fields 130 indicate the frequency of occurrence of the character that is the subject of frequency indicia bearing card 10. The frequency of occurrence as set forth in indicia fields 130 is related to the number of times the character appears within the total number of frequency indicia bearing cards 10 in existence. While the indicia of the frequency of occurrence is set forth primarily as a numerical value for illustrative purposes it will be understood that the indicia can be any type of indicia capable of indicating the differing values of frequency of occurrence. For example, letters or colors can be used as the indicia of the present invention.

For example, consider the case wherein 100,000 frequency indicia bearing cards 10 are printed having an indicia value of one. Cards 10 having an indicia value of one are the most common type of card 10. Then, for example in one embodiment of the present invention, 80,000 cards 10 bearing an indicia value of two can be printed. Furthermore, for example, the number of frequency indicia bearing cards 10 printed with an indicia value of three can be 70,000.

This process can be continued, in accordance with one of the preferred embodiments of the invention, with each successively larger frequency of occurrence value disposed in indicia fields 130 being provided with a ten percent differential compared to the previous frequency of occurrence value. In this manner a single copy can be printed of the most rare of the frequency indicia bearing cards 10, those cards 10 having an indicia value of ten.

In one embodiment of the invention a starter set of frequency indicia bearing cards 10 can be sold to users. Additionally, supplementary sets or booster sets of cards 10 can be printed. A starter set of cards 10 can contain, for example, fifty frequency indicia bearing cards 10. Supplementary sets of cards 10 can contain, for example, fifteen frequency indicia bearing cards 10.

In one embodiment the distribution of values of the indicia of indicia field 130 in both the starter sets and the supplementary sets can be random. Alternately, the sets of cards 10 can be printed with a distribution that is biased in some manner. For example, more powerful frequency indicia bearing cards 10 can be disproportionally provided in supplementary sets rather than in starter sets in order to encourage the purchase of supplementary sets. However, the total occurrences of each frequency indicia bearing card 10, as indicated by indicia 130, must be maintained substantially accurate over the total number of frequency indicia bearing cards 10 sold in both types of sets regardless of the frequency distributions.

One possible distribution of frequency indicia bearing cards 10 suitable for use with the present invention is set forth in Table I. The ratios of the values of Table I are chosen for illustrative purposes only. It will be understood that many other ratios can be used for the collectible element and game element of the present invention. Furthermore, it will be understood that it is necessary for the ratios to be exact. It is important however that each value represent a higher or lower value of frequency of occurrence than a previous value.

TABLE I

| DENOMINATION | PERCENTAGE | NUMBER |
|---|---|---|
| 1 | 22 | 100,000 |
| 2 | 17 | 80,000 |
| 3 | 15 | 70,000 |
| 4 | 13 | 60,000 |
| 5 | 11 | 50,000 |
| 6 | 9 | 40,000 |
| 7 | 7 | 30,000 |
| 8 | 4 | 20,000 |
| 9 | 0.2 | 10,000 |
| 10 | 0.02 | 1,000 |

Another possible distribution of frequency indicia bearing 10 is set forth in Table II. In the distribution Table II there is a smaller frequency difference between the successive indicia one to eight. For example, while a value of eight is still more common than a value of seven the frequency difference may only be as small as a few percentage points.

TABLE II

| |
|---|
| 1 = 25:100 |
| 2 = 20:100 |
| 3 = 14:100 |

TABLE II-continued

| |
|---|
| 4 = 10:100 |
| 5 = 9:100 |
| 6 = 8:100 |
| 7 = 7:100 |
| 8 = 6:100 |
| 9 = 9:1000 |
| 10 = 1:1000 |

Several fields containing information related to the character that is the subject of frequency indicia bearing card 10 are provided on reverse side 12. Nationality field 25 of reverse side 12 sets forth the nationality of the character. When the character is American nationality field 25 can include the ethnic background of the character. DOB/DOD field 30 sets forth the date of birth and date of death of the character. It will be understood that in some cases the date information of DOB/DOD field 30 may not be known with very much certainty.

Occupation field 35 of reverse side 12 of cared 10 sets forth the known occupations of the character. The occupations can be listed in chronological order within occupation field 35. Personal field 40 provides some anecdotal information about the personal life of the character. The information in personal field 40 can vary in differing printings of frequency indicia bearing cards 10 for a character. Earlier versions can focus on the youth of the character.

A single incident of some interest in the life of the character is described in close-up field 45 The incident described in close-up field 45 is not necessarily one of any great significance. Background field 50 is also provided on reverse side 12. In the preferred embodiment of the invention background field 50 sets forth a summary of the entire life of the character. Background field 50 is the longest of the fields disposed on reverse side 12 of frequency indicia bearing card 10.

Special fact field 55 of reverse side 12 can set forth any piece of information related to the character. The information used in special fact field 55 should pertain to the period of the life of the character that is dealt with in the other fields. Alias field 60 includes all of the known nicknames of the character. The nicknames can be listed in order from the most well known to the least well known, in alphabetical order, or without any order. Claim to fame field 65 of indicia bearing cards 10 describes the single thing for which the character is most well known.

Many different games can be played using frequency of occurrence indicia bearing cards 10 of the present invention. One such game is a history challenge game that can be referred to as History Mystery. In History Mystery a player attempts to guess the identities of the historical figures disposed upon cards 10 based upon clues. The clues can be the information in the various fields of frequency of occurrence card 10.

The guesses are made without the player seeing the name field 135 or the image field 120 on obverse side 14 of indicia bearing cards 10. The points, or credits, won by a player of History Mystery for correctly guessing the name of an historical figure are determined by the difficulty of making the identification. The difficulty of making the identification can be related to and indicated by the frequency of occurrence indicia of a card 10. In a preferred method points are awarded using frequency of occurrence indicia in combination with points provided of reverse side 12 of indicia bearing card 10. These points are placed before each field.

In one embodiment of the invention History Mystery can be played as a solitaire game. In this embodiment a player can look at reverse side 12 of card 10 but must not look at obverse side 14 until after a guess is made. If the guess made by the player is correct, as determined by looking at obverse side 14 after making a guess, the player is awarded a win. If the guess is incorrect the player receives a penalty.

The number of wins and losses received by the players can be tabulated in order to keep score if desired. However, no score keeping is necessary in the solitaire embodiment of History Mystery. In an alternate embodiment of History Mystery, differing numbers of points are awarded to the players for correct guesses and differing numbers of penalty points are awarded for incorrect guesses. The number of points awarded and the number of penalty points can be determined by the point values listed before each field in combination with the frequency of occurrence indicia of indicia bearing card 10. While only a few examples of these points are set forth in FIG. 1A showing reverse side 12 of card 10 in order to simplify the drawings, it will be understood that the number of points assigned to the various fields can be continued as shown or in any other manner.

The regular History Mystery game is played with two or more players. The players take turns picking a card from a pile and reading from the back of the card line by line to opposing players. The players can try to guess the name of the historical figure disposed on the front of the card based upon the information from the card in this manner. If a guess is correct the player making the correct guess can receive points, the number of points can be determined according to a second point value that can be provided upon card 10 as well as in the preferred embodiment, the card value. The received points and the card value points can be added to the previous point total of the player that guesses correctly.

If the guess is incorrect the player reading from the card can receive a number of points. The number of points received by the reading player can be determined by a first point value that can be provided upon card 10. The number of points indicated by the first line point value can be added to the face value of the player reading the information on the card. If no guess is made the reading player can receive points according to the card value as well as the highest first point value and add the points to the previous total.

If a player waits until the end of the reading of the information on the card to guess the identity of the historical figure it is desirable to award fewer points for a correct guess. Answering after more clues are given is easier that answering on the basis of fewer clues. Additionally, giving more points for answering correctly with fewer clues encourages some risk taking by the guessing player. Penalties can he imposed on players for incorrect guesses and the player holding the card can receive points if there are no guesses as previously described.

Rather than reading the information in the various sections on the back of the card in order to guess the figure indicated on the front the players can elect to dispose the card face up and guess the information in the various sections based upon their knowledge off the character shown. Points are awarded for correctly guessing the information on the back of the card rather than for guessing the identity of the historical figure on the front of the card. In an alternate embodiment one player at a time does the guessing.

In one embodiment of the intention History Mystery can be played as a solitaire game. In this embodiment a player can look at reverse side 12 of card 10 but must not look at obverse side 14 until after a guess is made. If the guess made by the player is correct as determined by looking at obverse side 14 after making a guess, the player is awarded a win. If the guess is incorrect the player receives a penalty.

The number of wins and losses received by the player can be tabulated in order to keep score if desired. However, no score keeping is necessary in the solitaire embodiment of History Mystery.

The History Mystery game of the present invention can be provided by means of images, such as video images, as well as by means of rigid cards, in the manner previously described. In such electronic embodiments of games using card 10 the software of the game can provide appearances of cards 10 according to the indicia of the frequency of occurrence of each card 10. Furthermore, the information of each field of each card 10 as well as the various questions required can all be programmed into the software of the game. The determinations when a player receives points and the number of points awarded to the player can also be programmed according to the rules of the games as set forth herein or according to the rules of any other games using cards 10 or using the indicia of the frequency of occurrence. For example, the software can provide more points for the guessing player if the guess is made with fewer clues. The same is true of the determinations of when players lose points and how many points they lose.

In a variation of the History Mystery game that can be referred to History Mystery League the players each provide their own sets of cards and the sets of cards are combined in order to form one large set of cards for use in playing the game. When playing this variation of History Mystery it may be useful for the players to mark their cards in order to facilitate separating them when the game is complete. In a further variation possible using indicia bearing cards 10 History Mystery League can be played by a number of players without mixing the sets of cards of the different players. The latter embodiment is believed to be preferred.

When playing a league version of History Mystery players having more than a predetermined number of cards that are permitted in the game must sort their cards and select only the predetermined number for use in the game. Players are permitted to select their cards in whatever manner they believe may provide them with any advantages they believe can be obtained using the selection process. However, the players can agree that predetermined numbers of cards in selected categories are required. For example, they may agree that all players must use at least a predetermined number of cards of certain colors. Play of the league version of History Mystery can then proceed as previously described with the players reading from their own selected cards as their turns to read periodically arise.

In any of the embodiments of History Mystery described herein the player whose turn it is to guess the identity of the historical figure on a card may be permitted to challenge the reader and determine whether the reader knows the identity of his or her own card. Alternately, the guessing player can raise the challenge by requiring the reading player to guess the identity of a historical figure of a card 10 from the deck or from a card 10 held by the guessing player.

Another game that can be played using collectible elements 10 as game elements is a game that can be referred to as History Challenge. In History Challenge the players simultaneously reveal the information on the back of their cards. The players then compete to see who can guess the identity of the historical character first. In one variation of the game which the players can elect to play the players can look at the reverse side of their own cards in order to determine the historical character disposed upon it. In the other variation of the game the players are not permitted to look at the reverse of their own cards. If the players are playing the variation wherein they do not know their own card the looser can challenge the winner on the winner's card.

A further game that can be played using indicia bearing cards 10 is Historeeno. In Historeeno the players first look at their own cards. The dealer then turns over the top card on a pile of remaining cards. A player must then match the color of the card turned over by the dealer from his or her own cards. Various strategies can be followed by the player who must match the color. In a preferred method the indicia of occurrence is also used for matching, thus cards of lesser occurrence may be sought after as matches.

Timeline and Lifeline are two further games that can be played using indicia bearing cards 10. In these games a predetermined number of cards are put into either (1) chronological order according to the birth date or the date of death of the historical character disposed upon the card, or (2) descending/ascending order according to how long the character lived. The winner in one of these games is the player who can put his or her cards into the selected order first. The cards which are more scarce normally hold more value as their degree of difficulty is greater for the opponent.

The previous description of the preferred embodiments is provided to enable a person skilled in the art to make and use the present invention. The various modifications to these embodiments will be readily apparent to those skilled in the art, and the generic principles defined herein can be applied to other embodiments without the use of the inventive faculty. For example, it will be understood that any of the games set forth herein, as well as any other games using the indicia of the frequency of occurrence or any other feature described, can be practiced as video or electronic games. Thus, the present invention is not intended to be limited to the embodiments shown herein but is to be accorded the widest scope consistent with the principles and novel features disclosed.

For example, the collectible elements of the present invention can be used in fantasy games as well as in the types of games described herein and many other types of games. Fantasy games can be games wherein the characters disposed on collectible elements 10 have attributes that can interact with the attributes of other characters in a strategic manner in order to perform a particular task in which a combination of attributes of the characters can prevail over an opponent and determine the winner of a game. The concept of fantasy games and attributes that can interact with each other in a strategic manner is known to those skilled in the art. In the case of the History Fantasy game certain key attributes such as movement and defensive capability are directly related to indicia of occurrence. Cards that are more scarce are more valuable in these attributes. The combination of the indicia of frequency of occurrence and the features of fantasy games such as the attributes produces games that are entertaining as well as educational.

What is claimed is:

1. A collectible element suitable for use in an educational game, comprising:

a plurality of collectible elements each collectible element having a frequency of occurrence related to the number of occurrences of the collectible element with respect to the number of collectible elements within the plurality of collectible elements to provide a plurality of differing frequencies of occurrence;

a plurality of differing indicia of frequency of occurrence, each indicia of said plurality of differing indicia of frequency of occurrence corresponding to an associated frequency of occurrence of said plurality of differing frequencies of occurrence; and a selected indicia of frequency of occurrence associated with the frequency of occurrence of a selected collectible element disposed upon the selected collectible element for representing the number of times the selected collectible element occurs within the plurality of collectible elements.

2. The collectible element of claim 1, wherein the collectible elements are cards and a player of the card game obtains credit in accordance with the frequency of occurrence.

3. The collectible element of claim 2, wherein the player of the game obtains credit in accordance with skill.

4. The collectible element of claim 3, wherein the collectible element sets forth a character and a player of the game obtains credit in accordance with skill in identifying the character.

5. The collectible element of claim 4, wherein the frequency of occurrence of a collectible element is related to the amount of skill required to identify the character set forth on the collectible element.

6. The collectible element of claim 2, wherein the credit comprises points applied to a player score.

7. The collectible element of claim 4, wherein the character set forth on the collectible element comprises a real person.

8. The collectible element of claim 7, wherein the character set forth on the collectible element comprises a dead person.

9. The collectible element of claim 8, wherein the character set forth on the collectible element comprises any dead person.

10. The collectible element of claim 4, wherein the character set forth on the collectible element comprises a relatively famous person and the frequency of occurrence of the collectible element is accordingly relatively high.

11. The collectible element of claim 4, wherein the character set forth on the collectible element comprises a relatively obscure person and the frequency of occurrence of the collectible element is accordingly relatively low.

12. The collectible element of claim 1, wherein the plurality of collectible elements comprises a first set of collectible elements obtained together with each other and a second set of collectible elements obtained together with each other and obtained separately from the first set of collectible elements wherein the first and second sets of collectible elements are joined together while substantially maintaining the accuracy of the frequency of occurrence of the collectible elements of the first and second sets of collectible elements.

13. The collectible element of claim 12, wherein the first and second sets of collectible elements include differing numbers of collectible elements therein.

14. The collectible element of claim 1, wherein the indicia of the frequency of occurrence of the collectible element comprises a number value from within a range of number values.

15. The collectible element of claim 14, wherein each successive number of the range of number values indicates a predetermined differential in the frequency of occurrence.

16. The collectible element of claim 14, wherein the range of number values spans a power of ten.

17. The collectible element of claim 5, wherein the characters have attributes for interacting with the attributes of other characters in a strategic manner.

18. The collectible element of claim 1, wherein the collectible elements are represented by corresponding electronic images.

19. The collectible element of claim 18, wherein appearances of an electronic image are controlled by algorithms provided in accordance with the indicia of the frequency of occurrence.

20. The collectible element of claim 18, wherein the appearances of the electronic images are controlled by algorithms provided in accordance with games rules.

21. A collectible element suitable for use in a fantasy game, comprising:

a plurality of collectible elements, each collectible element having a frequency of occurrence related to the number of occurrences of the collectible element with respect to the number of collectible elements within the plurality of collectible elements;

characters disposed on the collectible element wherein the characters have attributes for interacting with attributes of other characters;

a plurality of differing indicia of frequency of occurrence, each indicia of said plurality of differing indicia of frequency of occurrence corresponding to an associated frequency of occurrence of said plurality of differing frequencies of occurrence; and a selected indicia of frequency of occurrence associated with the frequency of occurrence of a selected collectible element disposed upon the selected collectible element for representing the number of times the selected collectible element occurs within the plurality of collectible elements.

22. The collectible element of claim 21, wherein the characters disposed on the collectible element comprise real people.

23. The collectible element of claim 21, wherein the characters disposed on the collectible element comprises dead people.

24. The collectible element of claim 23, wherein the characters disposed on the collectible element comprise any dead people.

25. The collectible element of claim 21, wherein the interaction of the characters disposed on the collectible element determines the winner of a game.

26. The collectible element of claim 21, wherein the indicia of the frequency of occurrence are represented by corresponding electronic images.

27. The collectible element of claim 26, wherein appearances of an electronic image are controlled by algorithms provided in accordance with the value of the indicia of the frequency of occurrence.

28. The collectible element of claim 25, wherein the appearances of the electronic images are controlled by algorithms provided in accordance with game rules.

29. The collectible element of claim 28, wherein the game rules include rules for awarding points to a player according to the a number of clues received by the player before the player provides a guess.

30. The collectible element of claim 1, wherein said frequency of occurrence determines a point value of said selected collectible element.

31. The collectible element of claim 21, wherein said frequency of occurrence determines a point value of said selected collectible element.

32. The collectible element of claim 1, wherein said selected indicia of frequency of occurrence is representative of the collectible value of said selected collectible element.

33. The collectible element of claim 32, wherein said selected indicia of frequency of occurrence comprises a numerical indicia.

34. The collectible element of claim 1, wherein the playing of said game is determined in accordance with said selected indicia of frequency of occurrence.

35. The collectible element of claim 34, wherein said selected indicia of frequency of occurrence is representative of the obscurity of a subject matter of said selected collectible element.

36. The collectible element of claim 34, wherein said selected indicia of frequency of occurrence is representative of the difficulty of determining a subject matter of said selected collectible element.

37. The collectible element of claim 34, wherein said selected frequency of occurrence determines a score in combination with other features of said collectible element.

38. The collectible element of claim 34, wherein the strength of an attribute of said selected collectible element is determined in occurrence with said frequency of occurrence.

39. The collectible element of claim 34, wherein said the movement of said selected collectible element is determined in accordance with said selected indicia of frequency of occurrence.

* * * * *